US010845016B2

(12) United States Patent
Jurik et al.

(10) Patent No.: US 10,845,016 B2
(45) Date of Patent: Nov. 24, 2020

(54) COORDINATED EFFECTS SYSTEM FOR AN AUTOMATED LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 15/516,399

(22) PCT Filed: Oct. 1, 2015

(86) PCT No.: PCT/US2015/053566

§ 371 (c)(1),
(2) Date: Apr. 1, 2017

(87) PCT Pub. No.: WO2016/054418

PCT Pub. Date: Apr. 7, 2016

(65) Prior Publication Data

US 2018/0187847 A1 Jul. 5, 2018

Related U.S. Application Data

(60) Provisional application No. 62/058,562, filed on Oct. 1, 2014.

(51) Int. Cl.
*F21S 10/00* (2006.01)
*F21V 5/00* (2018.01)
(Continued)

(52) U.S. Cl.
CPC ..... *F21S 10/007* (2013.01); *F21V 5/008* (2013.01); *F21V 5/02* (2013.01); *F21V 14/06* (2013.01); *F21W 2131/406* (2013.01)

(58) Field of Classification Search
CPC ... F21V 5/02; F21V 14/06–085; F21S 10/007
See application file for complete search history.

(56) References Cited

U.S. PATENT DOCUMENTS 3,584,226 A * 6/1971 Lerner ..... G06M 1/101 250/222.1
4,392,187 A 7/1983 Bornhorst
(Continued)

FOREIGN PATENT DOCUMENTS

CN 1711441 A 12/2005
CN 101430073 A 5/2009
(Continued)

OTHER PUBLICATIONS

PCT International Search Report; Application No. PCT/US2015/053566; dated Mar. 7, 2016; 5 pages.
(Continued)

*Primary Examiner* — Gerald J Sufleta, II
(74) *Attorney, Agent, or Firm* — Conley Rose, P. C.; Grant Rodolph; Brooks W Taylor

(57) ABSTRACT

Described is dynamic and coordinated control of the insertion and positioning of multiple prism effects systems installed in an automated luminaire. Positioning sensors allow the precise control of the relative orientation of two or more prism rotation systems.

14 Claims, 8 Drawing Sheets

(51) Int. Cl.

| | |
|---|---|
| ***F21V 5/02*** | (2006.01) |
| ***F21V 14/06*** | (2006.01) |
| *F21W 131/406* | (2006.01) |

(56) References Cited

U.S. PATENT DOCUMENTS

| | | | | |
|---|---|---|---|---|
| 4,891,738 | A | 1/1990 | Richardson et al. | |
| 4,980,806 | A * | 12/1990 | Taylor | G05B 19/0421 315/316 |
| 5,537,303 | A * | 7/1996 | Stacy | F21S 10/007 362/284 |
| 5,791,755 | A * | 8/1998 | Henry | F21S 10/007 353/120 |
| 5,934,794 | A * | 8/1999 | Hutton | F21S 10/007 362/283 |
| 6,502,964 | B1 | 1/2003 | Simon | |
| 9,664,361 | B2 * | 5/2017 | Hansen | F21S 10/00 |
| 2006/0187654 | A1 * | 8/2006 | Jungel-Schmid | F21S 10/007 362/147 |
| 2008/0055608 | A1 * | 3/2008 | Bornhorst | F21S 10/007 356/614 |
| 2009/0268466 | A1 * | 10/2009 | Allegri | F21V 5/048 362/268 |
| 2010/0073927 | A1 * | 3/2010 | Lewin | G02B 19/0061 362/240 |
| 2013/0094219 | A1 * | 4/2013 | Jurik | F21V 14/00 362/322 |
| 2014/0233238 | A1 | 8/2014 | Quadri et al. | |
| 2016/0195237 | A1 | 7/2016 | Quadri et al. | |
| 2019/0011820 | A1 | 1/2019 | Nohechi et al. | |

FOREIGN PATENT DOCUMENTS

| | | | |
|---|---|---|---|
| CN | 201416832 | Y | 3/2010 |
| CN | 202532389 | U | 11/2012 |
| CN | 203010295 | U | 6/2013 |
| CN | 103502865 | A | 1/2014 |
| CN | 203868942 | U | 10/2014 |
| CN | 107002973 | A | 8/2017 |
| DE | 102011113036 | A1 | 3/2012 |
| EP | 3056804 | A1 | 8/2016 |
| KR | 20140143065 | A | 12/2014 |
| WO | 9852386 | A1 | 11/1998 |
| WO | 2012138770 | A2 | 10/2012 |
| WO | 2016054418 | A1 | 4/2016 |

OTHER PUBLICATIONS

PCT Written Opinion of the International Searching Authority; Application No. PCT/US2015/053566; dated Mar. 7, 2016; 5 pages.
"Infinity iB-16R Manual"; https://www.highlite.nl/silver.download/Documents@extern@Manuals/41532_MANUAL_GB_V1.pdf; Dec. 31, 2014; 44 pages.
"Infinity iB-2R Manual"; https://www.warmlight.at/media/pdf/41531_MANUAL_GB_V1.pdf; Aug. 25, 2014; 36 pages.
Jurik, Pavel, et al.; U.S. Appl. No. 16/113,902, filed Aug. 27, 2018; Title: Coordinated Effects System for an Automated Luminaire; 34 pages.
Jurik, Pavel, et al.; U.S. Appl. No. 16/118,121, filed Aug. 30, 2018; Title: Framing System for an Automated Luminaire; 44 pages.
Office Action dated Nov. 19, 2018; U.S. Appl. No. 16/113,902, filed Aug. 27, 2018; 10 pages.
Office Action dated Oct. 29, 2018; U.S. Appl. No. 16/118,121, filed Aug. 30, 2018; 14 pages.
Chinese Office Action; Application No. 201580065444.6; dated Oct. 8, 2018; 12 pages.
European Extended Search Report; Application No. 18192006.7; dated Nov. 26, 2018; 6 pages.
European Partial Search Report; Application No. 18191994.5; dated Nov. 26, 2018; 11 pages.
European Examination Report; Application No. 15820914.8; dated Jul. 25, 2018; 6 pages.
Final Office Action dated Apr. 3, 2019; U.S. Appl. No. 16/113,902, filed Aug. 27, 2018; 24 pages.
Final Office Action dated Mar. 12, 2019; U.S. Appl. No. 16/118,121, filed Aug. 30, 2018; 27 pages.
European Intention to Grant; Application No. 15820914.8; dated Apr. 11, 2019; 10 pages.
European Extended Search Report; Application No. 18191994.5; dated Feb. 5, 2019; 10 pages.
Hecht, Eugene; "Chapter 5.5 Prisms"; Optics, 4th Edition; Addison-Wesley; 2002; 8 pages.
Advisory Action dated Jun. 4, 2019; U.S. Appl. No. 16/113,902, filed Aug. 27, 2018; 3 pages.
Office Action dated Jul. 24, 2019; U.S. Appl. No. 16/113,902, filed Aug. 27, 2018; 22 pages.
Office Action dated Jul. 26, 2019; U.S. Appl. No. 16/113,902, filed Aug. 27, 2018; 24 pages.
Advisory Action dated Jun. 4, 2019; U.S. Appl. No. 16/118,121, filed Aug. 30, 2018; 5 pages.
Office Action dated Aug. 20, 2019; U.S. Appl. No. 16/118,121, filed Aug. 30, 2018; 28 pages.
Chinese Office Action; Application No. 201580065444.6; dated Jun. 20, 2019; 13 pages.
European Examination Report; Application No. 18191994.5; dated Jun. 24, 2019; 5 pages.
Chinese Office Action; Application No. 201580065444.6; dated Oct. 9, 2019; 11 pages.
Chinese Office Action; Application No. 201811023325.6; dated Nov. 21, 2019; 21 pages.
Notice of Allowance dated Apr. 15, 2020; U.S. Appl. No. 16/113,902, filed Aug. 27, 2018; 21 pages.
Chinese Notification of Allowance; Application No. 201580065444.6; dated Mar. 18, 2020; 5 pages.
Chinese Office Action; Application No. 201811023325.6; dated Apr. 27, 2020; 22 pages.
Notice of Allowance dated Mar. 30, 2020; U.S. Appl. No. 16/118,121, filed Aug. 30, 2018; 18 pages.
European Intention to Grant; Application No. 18191994.5; dated Jan. 3, 2020; 11 pages.

* cited by examiner

COORDINATED EFFECTS SYSTEM FOR AN AUTOMATED LUMINAIRE

CROSS-REFERENCE TO RELATED APPLICATIONS

This application is a U.S. National Stage of International Patent Application No. PCT/US2015/053566 filed Oct. 1, 2015 by Pavel Jurik, et al. entitled "Improved Coordinated Effects System for an Automated Luminaire", which claims priority to U.S. Provisional Application No. 62/058,562 filed Oct. 1, 2014 by Pavel Jurik, et al. entitled, "System and Method for Controlling the Movement of LEDs in a Luminaire."

TECHNICAL FIELD OF THE DISCLOSURE

The present disclosure generally relates to an effects system in a luminaire, and more specifically to a system for coordinating multiple effects within an automated luminaire.

BACKGROUND

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern. FIG. 1 illustrates a typical prior art multiparameter automated luminaire system 10. These systems typically include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each automated luminaire 12 is connected in series or in parallel to data link 14 to one or more control desks 15. An operator typically controls the automated luminaire system 10 through the control desk 15.

An optical effect that is commonly used in prior art automated luminaires is often referred to as a prism. This is typically a glass or plastic device placed at a point in the optical train such that it converts a single image produced by the beam color, size, shape, and pattern optical systems into multiple beams for display. For example, a linear prism may convert a single beam into a linear array of identical beams. A diagrammatic example of the effects produced by a prior art prism effects system is shown in FIGS. 2 and 3. In FIG. 2, single image 20, produced by the beam color, size, shape, and pattern optical systems, passes through prism 21*a* resulting in multiple copies of image 20 as images 22*a*. Prism 21*a* may be rotated, as shown by arrow 23, causing a similar rotation, shown by arrow 24, in the array of output images. FIG. 3 shows the same optical system and prism, but with prism 21*b* rotated to a new position resulting in a corresponding rotation of the output images 22*b*. Image 20 is here shown for clarity as a simple circular image, however in reality image 20 may be any complex image as produced by the automated luminaire, in particular it may have a shape defined by the patterns or gobos in the optical train.

In further prior art systems the prism may be a different shape and may be capable of being inserted or removed from the light beam automatically. It may further be possible to select different prisms producing different effects for insertion in the beam. However, the prior art systems are only capable of introducing a single prism at one time.

It would be advantageous to provide a system for an automated luminaire that was capable of introducing a plurality of prisms into the optical effect chain simultaneously such that the effects concatenate. It would further be advantageous to be able to selectively and cooperatively coordinate the insertion, position, and rotation of the plurality of prisms to produce new dynamic lighting effects.

BRIEF DESCRIPTION OF THE DRAWINGS

For a more complete understanding of the present disclosure and the advantages thereof, reference is now made to the following description taken in conjunction with the accompanying drawings in which like reference numerals indicate like features and wherein.

DETAILED DESCRIPTION OF THE DISCLOSURE

Preferred embodiments of the present disclosure are illustrated in the FIGUREs, like numerals being used to refer to like and corresponding parts of the various drawings.

The present disclosure generally relates to an effects system in a luminaire, and more specifically to a system for coordinating multiple effects within an automated luminaire.

Figure 4:
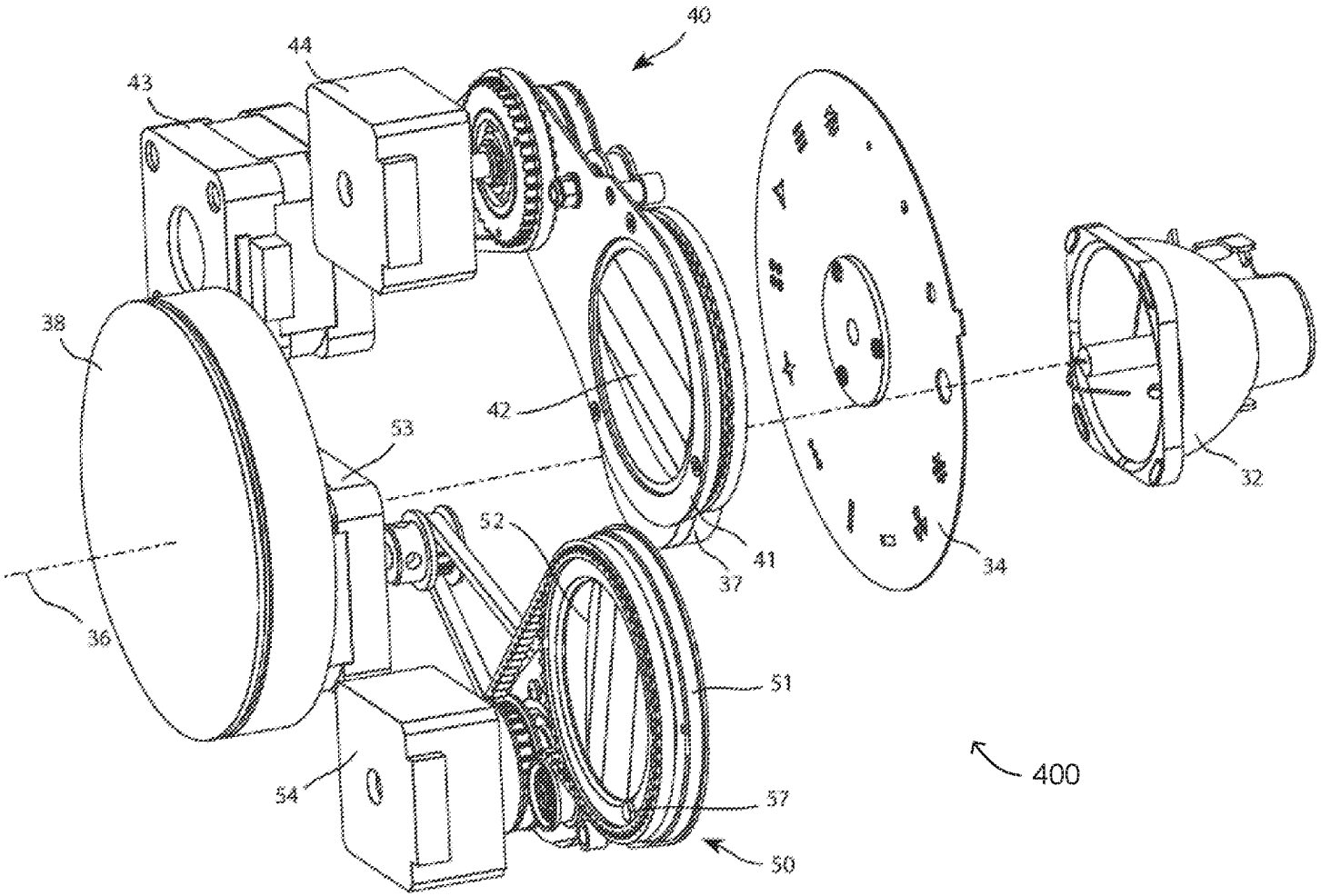
FIG. 4 illustrates an embodiment of the disclosure with all prisms removed from the light beam.

FIG. 4 illustrates an embodiment of the disclosure with all prisms removed from the light beam. Light source 32 produces a light beam whose optical axis is shown by dotted line 36. The light beam may pass through gobo wheel 34 and optical lenses 37 and 38 before being emitted from the luminaire. The system is shown here much simplified for clarity and, in practice, the automated luminaire may include further optical devices including but not restricted to, color wheel, color mixing, rotating gobo, effects wheel, iris, framing shutters, and other optical devices well known in the art.

The embodiment shown further includes first prism system 40. First prism system 40 may comprise first prism 42 rotatably contained within first prism arm 41. Motor 44 may be capable of rotating first prism 42 within first prism arm 41. Motor 43 may be capable of inserting or removing first prism arm 41 containing first prism 42 from the light beam. Motors 43 and 44 may be operated in a coordinated manner such that first prism 42 may be inserted or removed from the light beam and rotated within the light beam as desired by the operator. Motors 43 and 44 may be of a type selected from, but not restricted to, stepper motor, servo-motor, actuator, solenoid, and other motor types well known in the art. In the position shown in FIG. 4 first prism 42 is shown positioned outside of the light beam and will have no effect on the exiting light beam.

The embodiment shown further includes second prism system 50. Second prism system 50 may comprise second prism 52 rotatably contained within second prism arm 51. Motor 54 may be capable of rotating second prism 52 within second prism arm 51. Motor 53 may be capable of inserting or removing second prism arm 51 containing second prism 52 from the light beam. Motors 53 and 54 may be operated in a coordinated manner such that second prism 52 may be inserted or removed from the light beam and rotated within the light beam as desired by the operator. Motors 53 and 54 may be of a type selected from, but not restricted to, stepper motor, servo-motor, actuator, solenoid, and other motor types well known in the art. In the position shown in FIG. 4 second prism 52 is shown positioned outside of the light beam and will have no effect on the exiting light beam.

Both first and second prism systems 40 and 50 may further contain sensors such that the control system of the automated luminaire is aware of, and in control of, the specific orientation of rotation of first and second prisms 42, 52. For example, as illustrated in FIG. 4 second prism 52 is fitted with a magnet 57 in its periphery that rotates with second prism 52. A corresponding sensor or sensors (not shown) such as a Hall effect sensor in second prism system 50 may detect the position of magnet 57, and thus deduce the rotational position of second prism 52. Similarly first prism system 40 may be fitted with a magnet and sensor or sensors such that the rotational position of first prism 42 is known and communicated to the control system. The sensor system is not restricted to a magnet and Hall effect sensor, and any sensing system may be utilized in further embodiments of the disclosure including, but not restricted to, magnetic sensors, optical sensors, and switch sensors.

Figure 1:
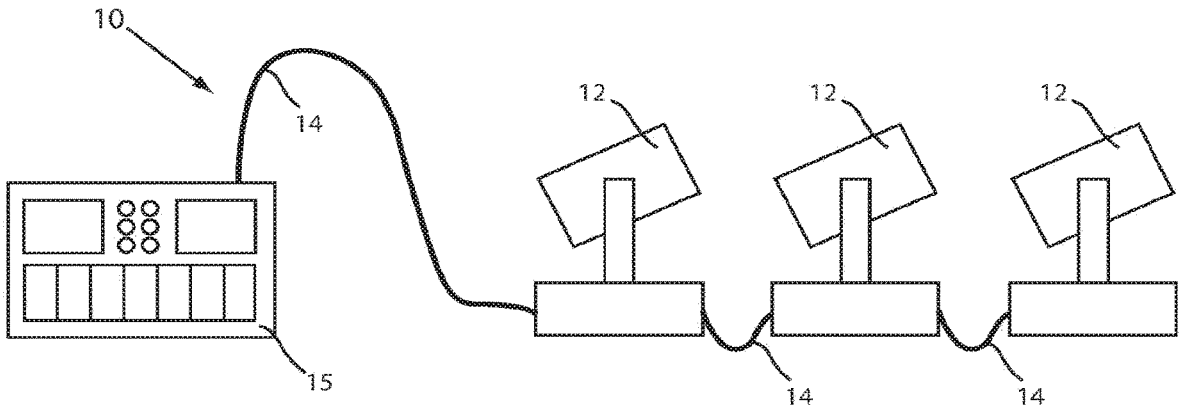
FIG 1 PRIOR ART
FIG. 1 illustrates a typical prior art multiparameter automated luminaire system.
Figure 2:
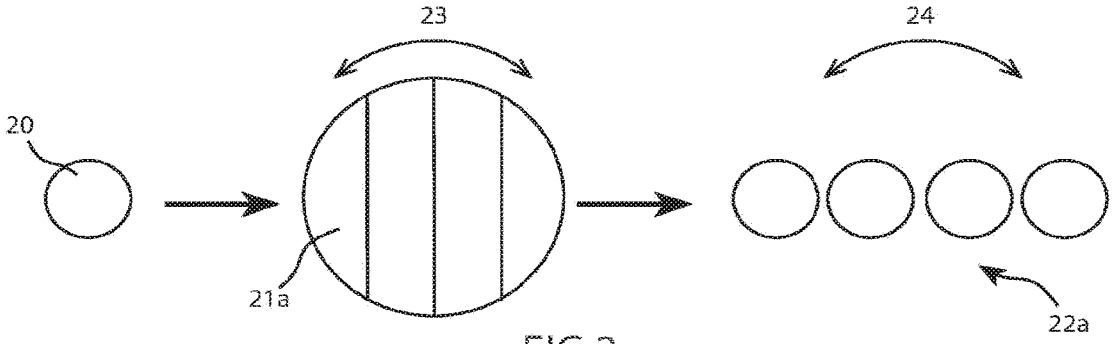
FIG 2 PRIOR ART
FIG. 2 illustrates a prior art prism effects system.
Figure 3:
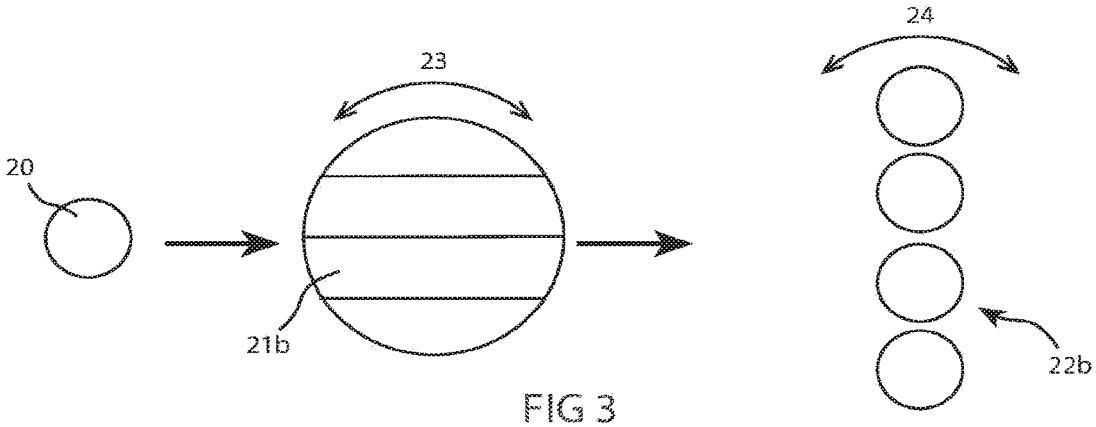
FIG 3 PRIOR ART
FIG. 3 illustrates a prior art prism effect system.
Figure 5:
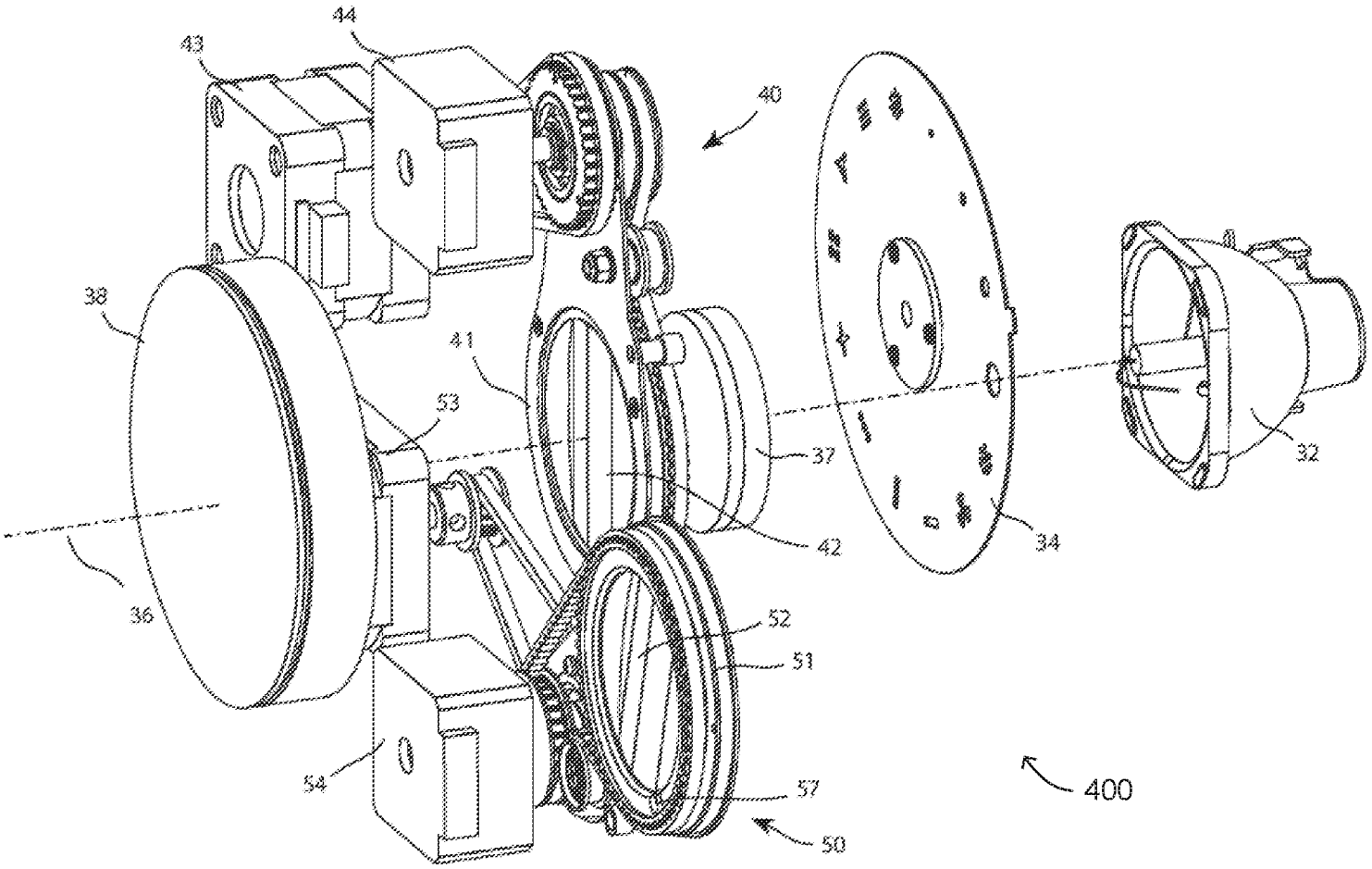
FIG. 5 illustrates an embodiment of the disclosure with a first prism inserted in the light beam.

FIG. 5 illustrates an embodiment of the disclosure with first prism inserted in the light beam. In FIG. 5 motor 43 has been operated so that first prism arm 41 and thus first prism 42 has been inserted across the light beam. Second prism 52 remains outside the light beam. In this position first prism 42 alone will produce an effect in the light beam. First prism 42 may be further rotated within the light beam by motor 44 producing effects similar to those illustrated in FIGS. 2 and 3.

Figure 6:
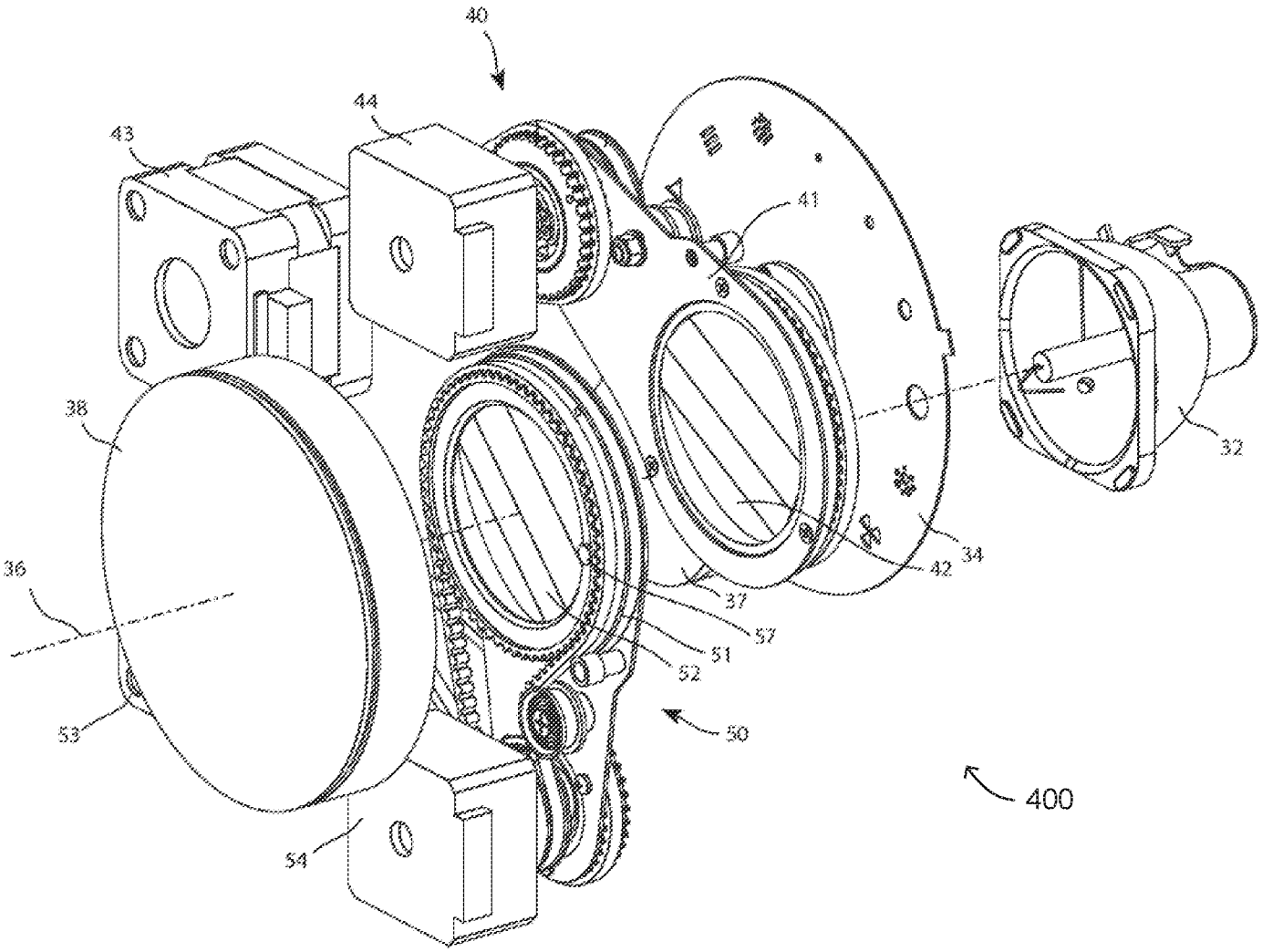
FIG. 6 illustrates an embodiment of the disclosure with a second prism inserted in the light beam.

FIG. 6 illustrates an embodiment of the disclosure with second a prism inserted in the light beam. In FIG. 6 motor 53 has been operated so that second prism arm 51 and thus second prism 52 has been inserted across the light beam. First prism 42 remains outside the light beam. In this position second prism 52 alone will produce an effect in the light beam. Second prism 52 may be further rotated within the light beam by motor 54 producing effects similar to those illustrated in FIGS. 2 and 3.

Figure 7:
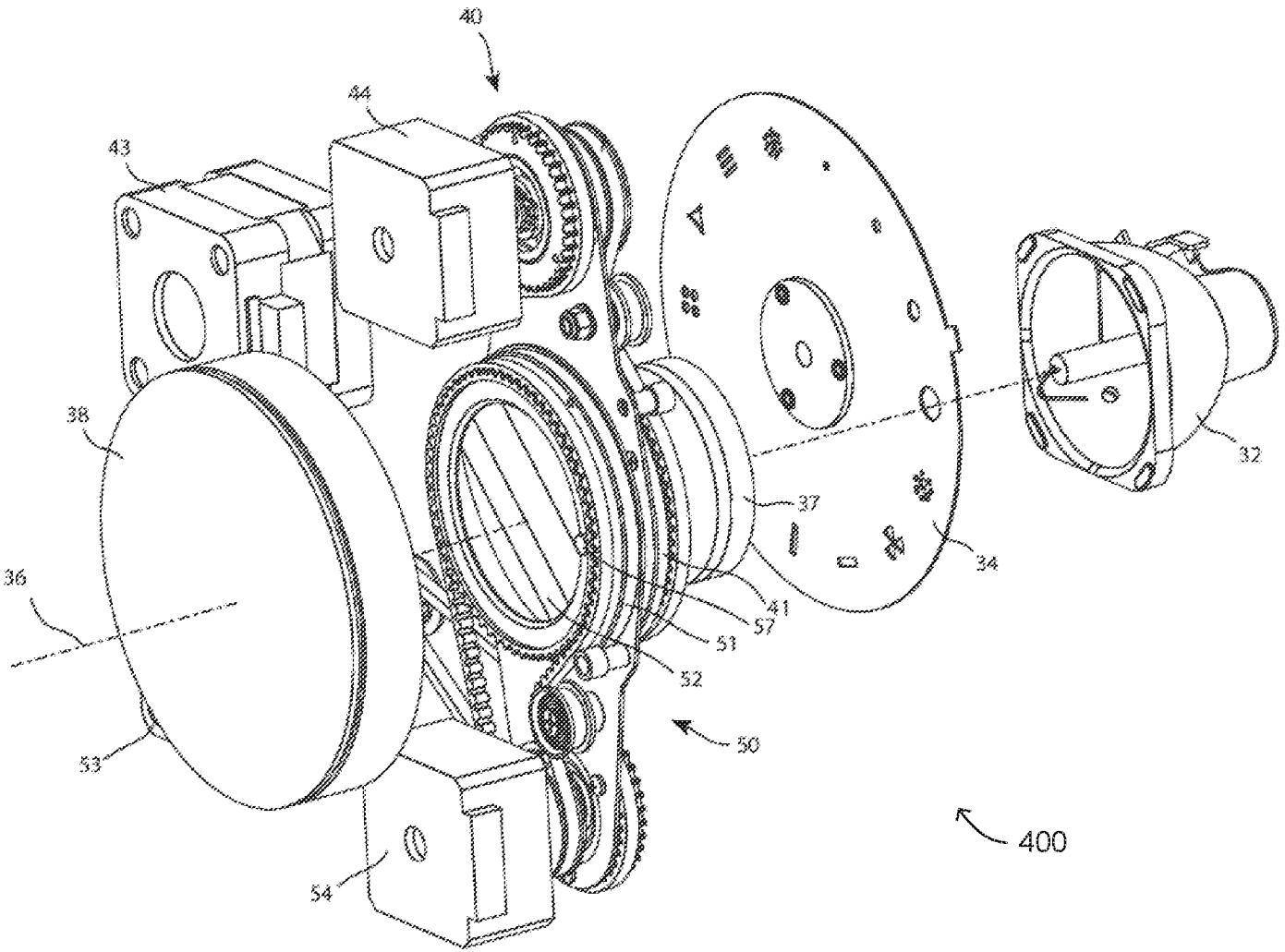
FIG. 7 illustrates an embodiment of the disclosure with the first and second prisms inserted in the light beam.

FIG. 7 illustrates an embodiment of the disclosure with the first and second prisms inserted in the light beam. In FIG. 7 motor 43 has been operated so that first prism arm 41 and thus first prism 42 has been inserted across the light beam. Further, motor 53 has also been operated so that second prism arm 51 and thus second prism 52 has been inserted across the light beam. In this position both first prism 42 and second prism 52 alone will produce effects in the light beam. First prism 42 and second prism 52 may be further rotated within the light beam by motors 44 and 54. Second prism 52 receives the light beam after it has passed through, and been affected by, first prism 42. Thus, the effect produced by first prism 42 is then further modified by second prism 52.

Figure 8:
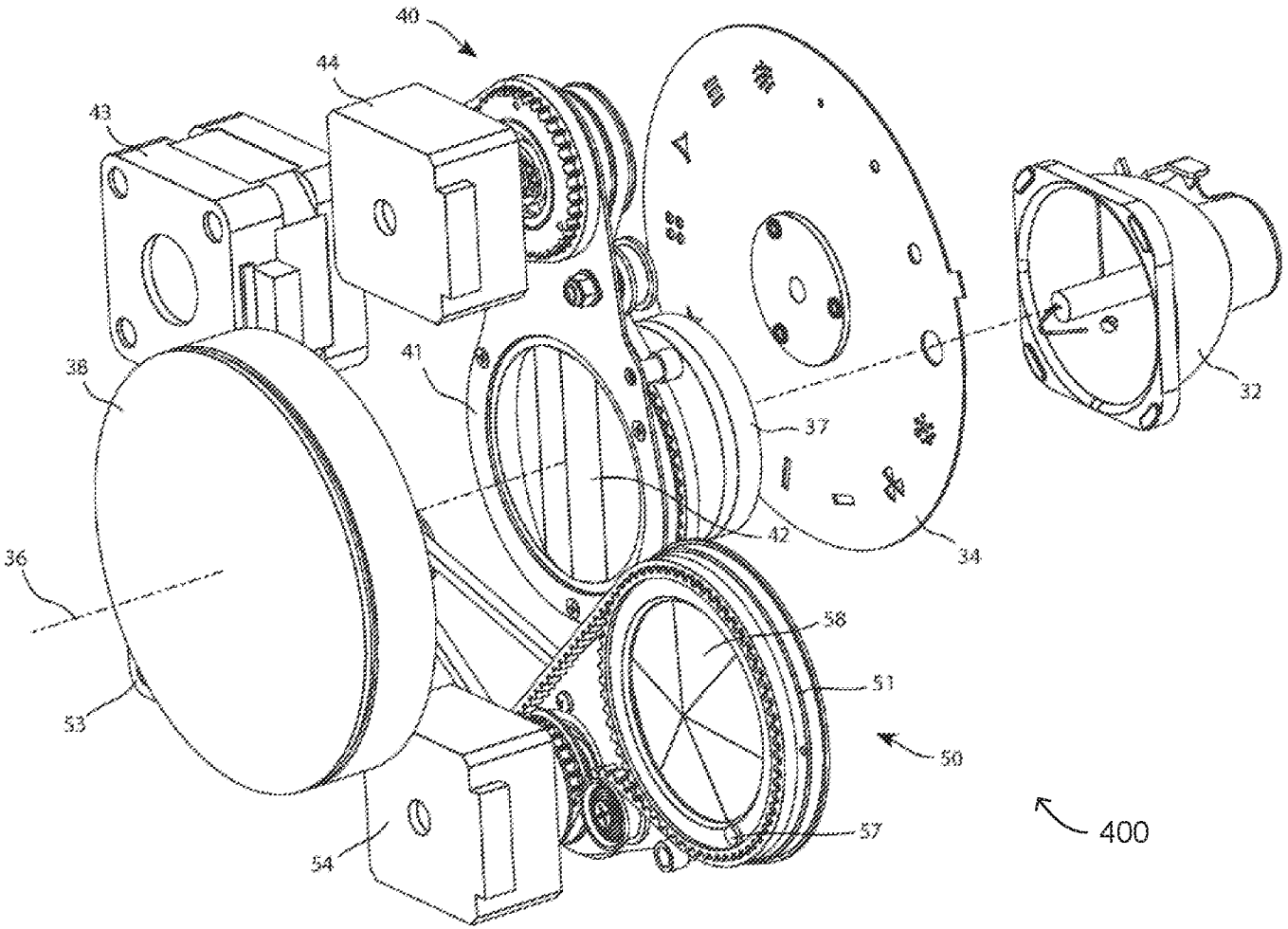
FIG. 8 illustrates an embodiment of the disclosure with an alternative second prism.

FIG. 8 illustrates an embodiment of the disclosure with an alternative second prism 58 inserted within second prism arm 51. Similarly first prism 42 may be replaced with alternative prism designs.

Figure 9:
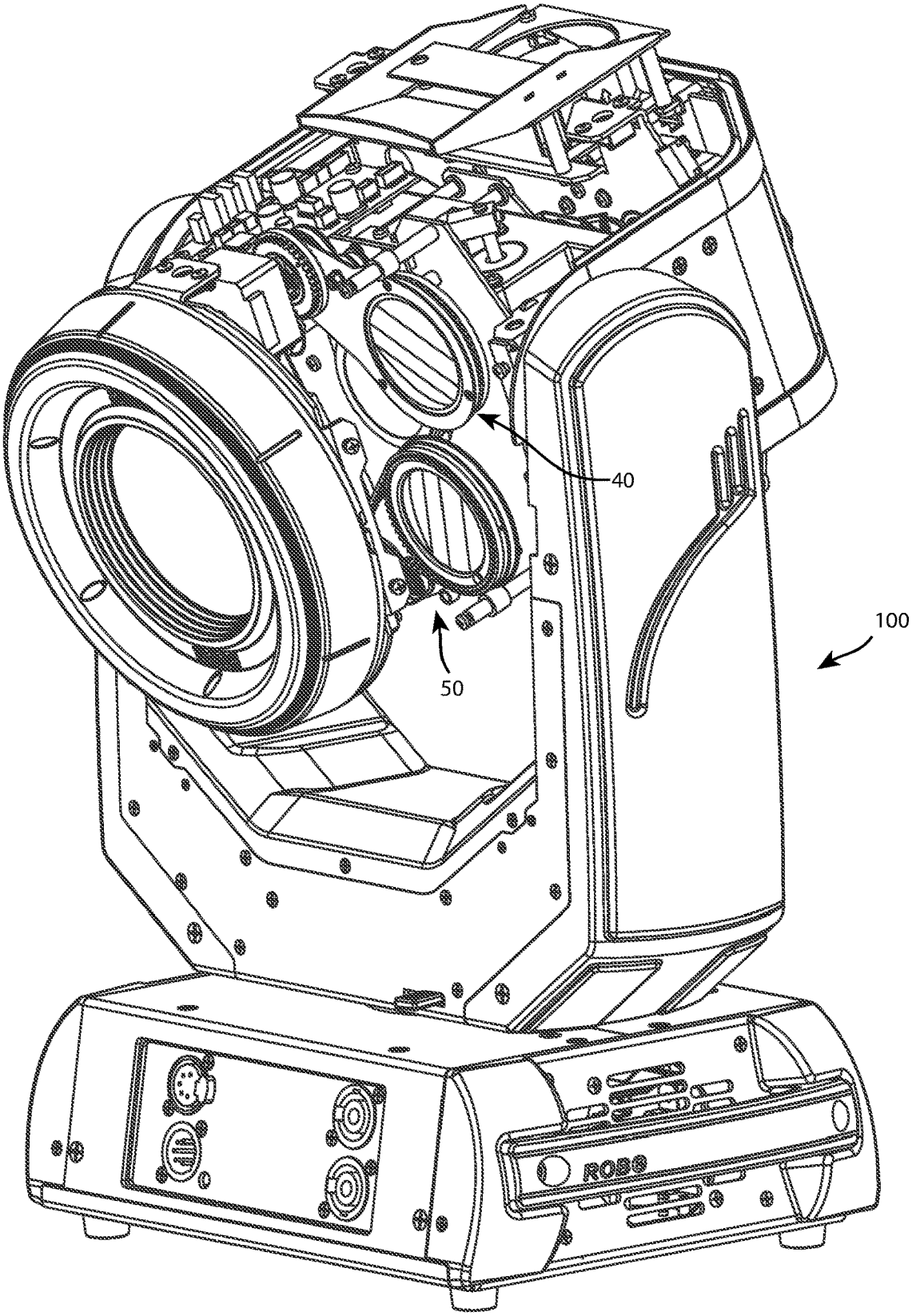
FIG. 9 illustrates an automated luminaire fitted with the first prism system and second prism system.

FIG. 9 illustrates an example of automated luminaire 100 fitted with first prism system 40 and second prism system 50.

Figure 10:
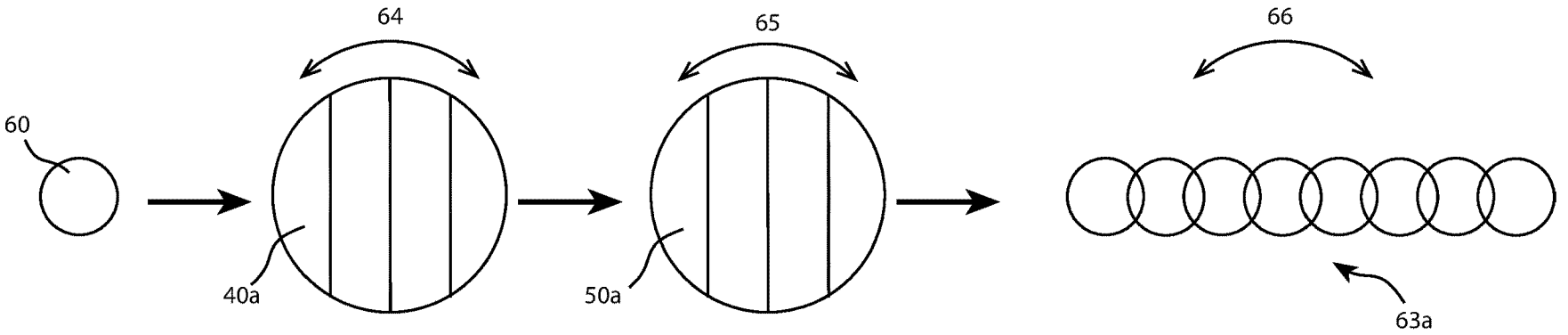
FIG. 10 illustrates an embodiment of the prism effects system.
Figure 11:
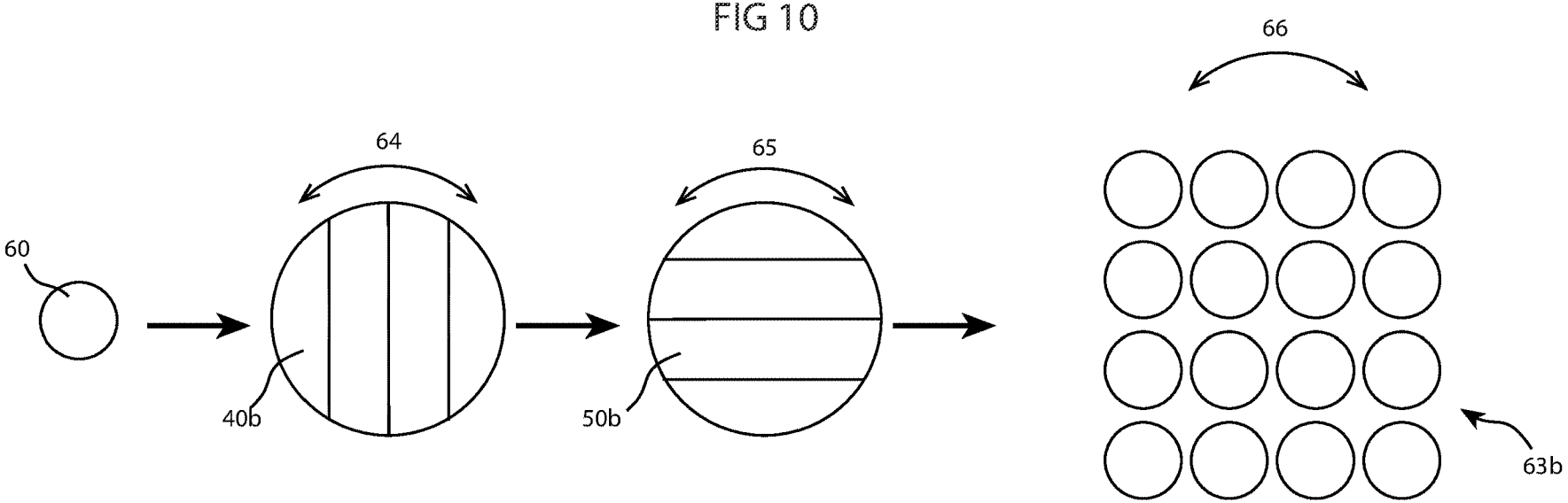
FIG. 11 illustrates an embodiment of the prism effects system.

Diagrammatic examples of the effects produced by the prism effects system according to an embodiment of the disclosure are shown in FIGS. 10 and 11. In FIG. 10, single image 60, produced by the beam color, size, shape, and pattern optical systems passes through first prism 40*a* and second prism 50*a* resulting in multiple copies of image 60 as images 63*a*. Image 60 is here shown for clarity as a simple circular image, however in reality image 60 may be any complex image as produced by the automated luminaire, in particular it may have a shape defined by the patterns or gobos in the optical train.

Because first prism 40*a* and second prism 50*a* are both linear prisms and are aligned in a parallel manner, the resultant image 63*a* is also linearly aligned. However, both first prism 40*a* and second prism 50*a* may be rotated, as shown by arrows 64 and 65, causing a change in pattern and rotation, as shown by arrow 66, in the array of output images 63*a*.

FIG. 11 shows the same optical system and prism, first prism 40*b* remains in the same position as in FIG. 10, however second prism 50*b* is rotated 90° to a new position orthogonal to its first position. In this case the linear effect of first prism 40*b* still forms a single linear array of images, however second prism 50*b* now acts on that first linear array in an orthogonal direction, resulting in a linear array of images 63*b*. It can be readily appreciated that intermediate angles between first prism 40*b* and second prism 50*b* will produce intermediate effects between those shown in FIG. 10 and FIG. 11.

In a further embodiment first prism 40*a* and second prism 50*a* may be simultaneously rotated in a coordinated manner such that the angle between them remains constant. For example, both prisms may be rotated in the same direction at the same speeds thus maintaining the difference in angle between them. The sensors fitted to first and second prisms allow the control system to maintain coordination in the rotation and positioning of the prisms. In a yet further embodiment, first and second prisms may be rotated in a coordinated manner at differing speeds and/or differing directions. Speeds and rotation directions and positions may be accurately controlled through sensors such that accurate and repeatable kaleidoscopic effects may be achieved.

Although embodiments with two prism systems have been illustrated and described, the disclosure is not so limited and any number of prism systems may be utilized to produce complex coordinated effects.

While the disclosure has been described with respect to a limited number of embodiments, those skilled in the art, having benefit of this disclosure, will appreciate that other embodiments may be devised which do not depart from the scope of the disclosure as disclosed herein. Accordingly, the scope of the disclosure should be limited only by the attached claims.

The disclosure has been described in detail, it should be understood that various changes, substitutions and alterations can be made hereto without departing from the spirit and scope of the disclosure as described by the appended claims

We claim:

1. An automated luminaire comprising:

a light source configured to generate a light beam;

a first prism arm comprising a first image replicating prism, the first prism arm configured to be moved to first, second, and third positions, in the first position, the first image replicating prism being engaged with the light beam, in the second position, the first image replicating prism being partially engaged with the light beam, in the third position, the first image replicating prism being disengaged with the light beam, the first prism arm comprising a first stepper motor configured to rotate the first image replicating prism;

a second prism arm comprising a second image replicating prism, the second prism arm configured to be moved to fourth, fifth, and sixth positions, in the fourth position, the second image replicating prism being engaged with the light beam, in the fifth position, the second image replicating prism being partially engaged with the light beam, in the sixth position, the second image replicating prism being disengaged with the light beam, the second prism arm comprising a second stepper motor configured to rotate the second image replicating prism;

a sensing system comprising a position indicator and sensor, the sensing system configured to detect a rotational position of the first image replicating prism and a rotational position of the second image replicating prism; and a control system comprising control electronics coupled to the first and second stepper motors and the sensing system and configured to use the sensing system to control, simultaneously and in a coordinated manner, rotation directions, rotation speeds, and rotational positions of the first and second image replicating prisms, wherein the first image replicating prism is configured to produce a first modified light beam comprising a first plurality of copies of a first image in a first light beam received by the first image replicating prism and the second image replicating prism is configured to produce a second modified light beam comprising a second plurality of copies of a second image in a second light beam received by the second image replicating prism.

2. The automated luminaire of claim 1 wherein the first plurality of copies of the first image are produced in a first straight line and the second plurality of copies of the second image are produced in a second straight line.

3. The automated luminaire of claim 1 wherein the automated luminaire further comprises a gobo wheel or an image/light-pattern generator.

4. The automated luminaire of claim 3 wherein the gobos of the gobo wheel or the light patterns of the image/light-pattern generator are rotatable.

5. The automated luminaire of claim 1, wherein the first image replicating prism and the second image replicating prism are both linear prisms and are aligned in a parallel manner.

6. The automated luminaire of claim 1, wherein the sensing system comprises a first sensor configured to detect the rotational position of the first image replicating prism and a second sensor configured to detect the rotational position of the second image replicating prism.

7. The automated luminaire of claim 6, wherein the sensing system comprises first and second position indicators comprising first and second magnets, respectively, wherein the first magnet is fitted in a periphery of the first image replicating prism and rotates with the first image replicating prism and the second magnet is fitted in a periphery of the second image replicating prism and rotates with the second image replicating prism, and wherein the first and second sensors are configured to detect the rotational positions of the first magnet and the second magnet, respectively.

8. The automated luminaire of claim 1, wherein the control system is configured to simultaneously rotate the first image replicating prism and the second image replicating prism in the same rotation direction at the same rotation speed such that an angle between the first image replicating prism and the second image replicating prism remains constant.

9. The automated luminaire of claim 1, wherein the control system is configured to simultaneously rotate the first image replicating prism and the second image replicating prism in different rotation directions at different rotation speeds.

10. The automated luminaire of claim 1, wherein:

the first plurality of copies of the first image are produced in a first straight line and the second plurality of copies of the second image are produced in a second straight line; and the control system is configured to:

move the first prism arm to the first position and the second prism arm to the fourth position;

rotate the second image replicating prism to a first rotational position relative to the first image replicating prism, the first rotational position aligned with the first image replicating prism and producing a first output image;

rotate the second image replicating prism to a second rotational position relative to the first image replicating prism, the second rotational position orthogonal to the first image replicating prism and producing a second output image; and rotate the second image replicating prism to a third rotational position relative to the first image replicating prism, the third rotational position intermediate between the first and second positions and producing an output image intermediate between the first and second output images.

11. The automated luminaire of claim 10 wherein the control system is configured to rotate the second image replicating prism between the first and second rotational positions relative to the first image replicating prism, producing an output image varying between the first and second output images.

12. The automated luminaire of claim 10, wherein the control system is further configured to simultaneously rotate the first image replicating prism and the second image replicating prism in the same rotation direction at the same rotation speed.

13. The automated luminaire of claim 12, wherein the control system is further configured to simultaneously rotate the first image replicating prism and the second image replicating prism in different rotation directions.

14. The automated luminaire of claim 13, wherein the control system is further configured to simultaneously rotate the first image replicating prism and the second image replicating prism in the same rotation direction while rotating the second image replicating prism between the first and second rotational positions relative to the first image replicating prism, producing a rotating output image varying between the first and second output images.

* * * * *